US005884559A

United States Patent [19]

Okubo et al.

[11] Patent Number: 5,884,559

[45] Date of Patent: Mar. 23, 1999

[54] HELICAL THREAD PRINTING BLANKET

[75] Inventors: Hiromasa Okubo, Kobe; Toshikazu Ogita, Miki; Seiji Tomono, Kobe; Takamichi Sagawa, Akashi, all of Japan

[73] Assignee: Sumitomo Rubber Industries, Ltd., Kyogo, Japan

[21] Appl. No.: 988,455

[22] Filed: Dec. 10, 1997

[30] Foreign Application Priority Data

Dec. 13, 1996 [JP] Japan ..... 8-333888

[51] Int. Cl.[6] ..... B41N 10/04

[52] U.S. Cl. ..... 101/376; 101/379

[58] Field of Search ..... 101/375, 376, 101/379, 217; 428/909

[56] References Cited

U.S. PATENT DOCUMENTS

| | | | |
|---|---|---|---|
| 3,418,864 | 12/1968 | Ross | 101/407.1 |
| 4,812,357 | 3/1989 | O'Rell et al. | 428/246 |
| 5,066,537 | 11/1991 | O'Rell et al. | 428/246 |
| 5,347,927 | 9/1994 | Berna et al. | 101/401.1 |
| 5,352,507 | 10/1994 | Bresson et al. | 428/245 |
| 5,440,981 | 8/1995 | Vrotacoe et al. | 101/217 |
| 5,478,637 | 12/1995 | Tomono et al. | 428/246 |
| 5,768,990 | 6/1998 | Vrotacoe et al. | 101/217 |

FOREIGN PATENT DOCUMENTS

| | | | |
|---|---|---|---|
| 0514344A1 | 11/1992 | European Pat. Off. . | |
| 53-35028 | 4/1978 | Japan . | |
| A54-50620 | 4/1979 | Japan . | |
| A57-61717 | 4/1982 | Japan . | |
| A63-175110 | 7/1988 | Japan . | |
| A3-90613 | 4/1991 | Japan . | |
| 8-216548 | 8/1996 | Japan . | |
| 576866 | 6/1976 | Switzerland | 101/376 |
| 1139666 | 4/1967 | United Kingdom . | |

*Primary Examiner*—Edgar Burr
*Assistant Examiner*—Daniel J. Colilla

[57] ABSTRACT

A printing blanket according to the present invention is formed by laminating a non-stretchable layer obtained by winding a thread in helical fashion in the circumferential direction, a compressible layer comprising an elastomer and in a porous and a seamless cylindrical shape, and a surface printing layer similarly comprising an elastomer and in a seamless cylindrical shape in this order, whereby high-quality prints can be obtained in a wide range, and the degree of the degradation of printing properties due to the reduction in reaction force is low.

12 Claims, 4 Drawing Sheets

HELICAL THREAD PRINTING BLANKET

BACKGROUND OF THE INVENTION

1. Field of the Invention

The present invention relates to a printing blanket in a seamless cylindrical shape which is particularly suitable for use in high-speed web offset printing presses.

2. Description of the Prior Art

A printing blanket in a seamless cylindrical shape has been recently proposed as a printing blanket suitable for printing at all speeds from ordinary lithographic offset printing to high-speed printing done by a high-speed offset rotary printer or the like (e.g. Japanese Patent Laid-Open No. 301483/1993).

The above-mentioned printing blanket is formed by laminating a compressible layer comprising an elastomer such as rubber and formed in a porous and seamless cylindrical shape, a non-stretchable layer which is nonstretchable in the circumferential direction, and a surface printing layer comprising an elastomer formed in a seamless cylindrical shape in this order on the outer periphery of a cylindrical sleeve mounted on a blanket cylinder.

The non-stretchable layer is formed on the compressible layer by winding a thread (for example, a thread such as a cotton string) which is non-stretchable in a longitudinal direction and is easy to deform in a direction perpendicular to the longitudinal direction in helical fashion in the circumferential direction while applying a tensile force thereto.

Such a non-stretchable layer has the function of preventing the occurrence of a phenomenon whereby a compressible layer or the like released from a compressive force produced by a plate cylinder or the like after passing through a nip deformed portion caused when it is pressed by the plate cylinder or the like at the time of printing excessively expands in the radial direction by elastic rebound forming a so-called bulge. The non-stretchable layer prevents the occurrence of such a phenomenon whereby the surface printing layer forms waves by repeating the above-mentioned nip deformation and creates bulge at high speed, that is, a stationary wave.

Furthermore, the non-stretchable layer also has the function of applying a radial preload to the compressible layer in order to improve the reaction force produced in pressing and deforming the printing blanket in the radial direction when it is pressed by the plate cylinder or the like. The magnitude of the preload and the magnitude of the reaction force are greatly related to the printing properties of the printing blanket and particularly to dot or solid applicability (the properties of forming prints without white spots) or to the properties of preventing deformation of dots such as double or slurry.

Specifically, the dot or solid applicability depends on the magnitude of the reaction force of the printing blanket. The larger the preload applied by the non-stretchable layer and the larger the reaction force, the better the dot or solid applicability is made.

On the other hand, the properties of preventing the deformation of dots depend on the degree to which the bulge is absorbed ahead of and behind the nip deformed portion. The smaller the preload applied by the non-stretchable layer, and the smaller the reaction force of the printing blanket and the more easily the bulge is absorbed. Therefore, the properties of preventing the deformation of dots are improved. The reason for this is that the deformation of dots is mainly caused by the elongation in the circumferential direction of the surface printing layer by the occurrence of the bulge.

In the case where no preload is applied, or the case where the preload is too light, the properties of preventing the deformation of dots are improved, while the dot or solid applicability is degraded. On the contrary, in the where the preload is too heavy, the dot or solid applicability is improved, while the properties of preventing the deformation of dots such as double or slurry are degraded.

Therefore, the tensile force or the like in winding a thread composing the non-stretchable layer is established by considering the balance between both the properties, that is, by finding the range of the magnitude of the preload in which the balanced results of printing in which the dot or solid applicability is good and the deformation of dots is prevented are obtained, in such a manner that the preload in the above-mentioned range occurs when the printing blanket is fabricated.

"Double" means that dots slip, so that double printing is done, and easily occurs by the slip in the direction in which paper sheets are discharged. When such double occurs, dots become large, so that the color of a portion represented by the dots is made darker than that in the other portion.

"Slurry" is a phenomenon that dots are out of shape, so that dots warps having the shape of bristles or the tail of a comet.

In the printing blanket of the above-mentioned conventional construction, the preload always continues to be applied from the non-stretchable layer to the compressible layer even if it is not employed, whereby rubber composing the compressible layer easily causes stress relaxation due to compression set. Correspondingly, the preload is decreased by the non-stretchable layer and therefore, the dot or solid applicability is easily degraded, for example, due to the reduction in the reaction force of the printing blanket with time.

Therefore, in employing the above-mentioned printing blanket, printing conditions such as a pressing force (the amount of depression) of the plate cylinder or the like must be frequently adjusted in conformity to the degradation of the dot or solid applicability due to the reduction in the reaction force, that is, the amount of depression must be frequently increased in order to maintain the dot or solid applicability in a suitable state, for example.

Finally, at the time where the rubber composing the compressible layer causes compression set to such a degree that the degradation of the dot or solid applicability cannot be sufficiently covered only by adjusting the amount of depression or the like, or the degree of the deformation of dots such as double or slurry exceeds the allowable range because the amount of depression is too large to sufficiently absorb the bulge ahead of and behind the nip deformed portion, the printing blanket cannot be employed.

SUMMARY OF THE INVENTION

An object of the present invention is to provide a printing blanket in which high-quality prints can be obtained in a wide range from ordinary printing to high-speed printing. Printing conditions need not be frequently adjusted because the degree to which printing properties are degraded due to the reduction in reaction force with time is low, and good printing properties in the early stages of fabrication can be maintained over a longer time period when compared to the conventional example.

A printing blanket according to the present invention comprises (a) a non-stretchable layer obtained by winding a thread which is non-stretchable in a longitudinal direction and is easy to deform in a direction perpendicular to the longitudinal direction in a helical fashion in the circumferential direction, (b) a compressible layer, which is laminated on the non-stretchable layer comprising an elastomer and formed in a porous and seamless cylindrical shape, and (c) a surface printing layer, which is laminated on the compressible layer comprising an elastomer and formed in a seamless cylindrical shape.

In the printing blanket according to the present invention, the non-stretchable layer is arranged inside the compressible layer as described above, and no preload applied by the non-stretchable layer is exerted, whereby the rubber making up the compressible layer does not easily cause stress relaxation due to compression set. Accordingly, the printing blanket according to the present invention does not degrade dot or solid applicability due to the reduction in the reaction force with time, for example.

Furthermore, the compressible layer is arranged almost directly below the surface printing layer, and the non-stretchable layer is arranged almost directly below the compressible layer. The occurrence of a bulge and the resultant elongation in the circumferential direction of the surface printing layer are prevented by the synergistic action of both of the layers. Therefore, the printing blanket, according to the present invention, does not cause deformation of dots such as double or slurry.

The printing blanket according to the present invention can prevent the occurrence of stripe-shaped non-uniformity in printing in the direction of a thread comprising the non-stretchable layer, that is, a streak because the compressible layer is interposed between the surface printing layer and the non-stretchable layer.

Accordingly, the printing blanket according to the present invention need not frequently adjust the printing conditions, unlike the above-mentioned conventional printing blanket because the degree to which the printing properties due to the reduction in the reaction force with time is low, and can maintain good printing properties in the early stages of fabrication over a longer time period, as compared with the conventional printing blanket.

Moreover, in the printing blanket according to the present invention, each of the respective layers including the non-stretchable layer, the compressible layer, and the surface printing layer has a structure in which there are no seams in the circumferential direction, whereby high-quality prints can be obtained in a wide range from ordinary printing to high-speed printing.

The compressible layer is laminated on the non-stretchable layer directly or with an adhesive layer interposed therebetween. The surface printing layer is laminated on the non-stretchable layer directly, or with an adhesive layer interposed therebetween.

Furthermore, in the present invention, it is preferable that the non-stretchable layer is formed on a base layer, which is formed on the outer periphery of a cylindrical sleeve mounted on a blanket cylinder directly or with an adhesive layer interposed therebetween, comprising an elastomer, being non-compressible and formed in a seamless cylindrical shape directly or with an adhesive layer interposed therebetween.

The base layer, together with the compressible layer and the surface printing layer, has the function of absorbing vibration, impact load or the like applied to the blanket at the time of printing, and also has the function of reinforcing and protecting the sleeve, whereby the durability of the printing blanket can be further improved.

In order to obtain a high-quality image in the present invention, it is preferable that the thickness of the non-stretchable layer is 0.15 to 1.0 mm, the compressible layer is 0.03 to 0.8 mm, and the surface printing layer is 0.2 to 0.6 mm.

As described later, when the compressible layer has a closed cell structure, the porosity thereof is preferably 20 to 80%. When the compressible layer has an open cell structure, the porosity thereof is preferably 10 to 70%.

Furthermore, in the printing blanket according to the present invention, a reaction force of 4.0 to 7.0 Kgf/cm is produced when the printing blanket is compressed and deformed in the radial direction such that the nip width in the circumferential direction is preferably 5 mm.

The foregoing and other objects, features, aspects and advantages of the present invention will become more apparent from the following detailed description of the present invention when taken in conjunction with the accompanying drawings.

PREFERRED EMBODIMENTS OF THE PRESENT INVENTION

Figure 1:
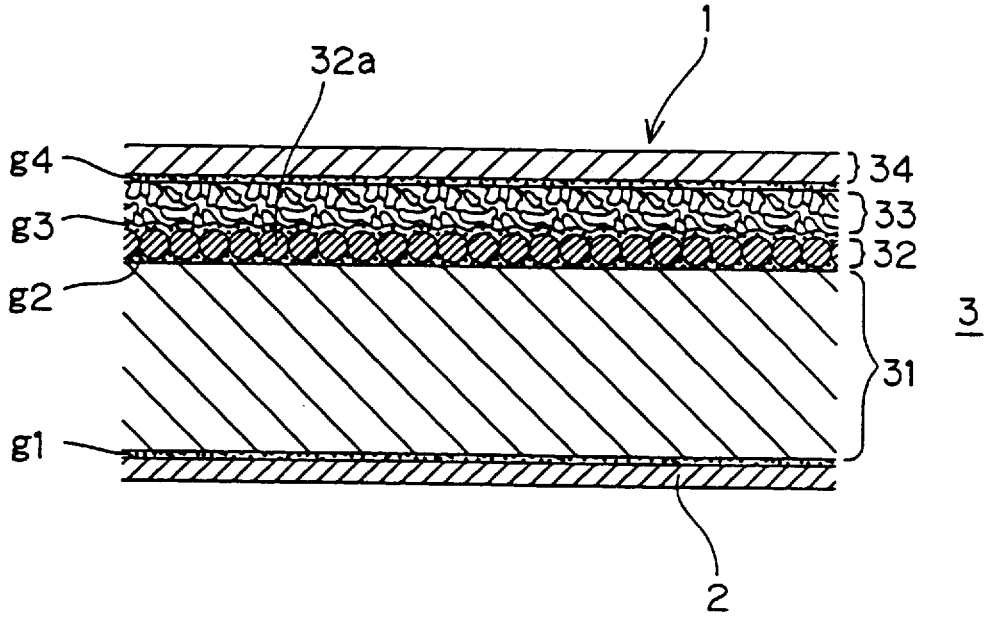
FIG. 1(*a*) is a cross-sectional view showing one embodiment of a printing blanket according to the present invention, and FIG. 1(*b*) is an enlarged sectional view showing a principal part of the above-mentioned embodiment.
Figure 1:
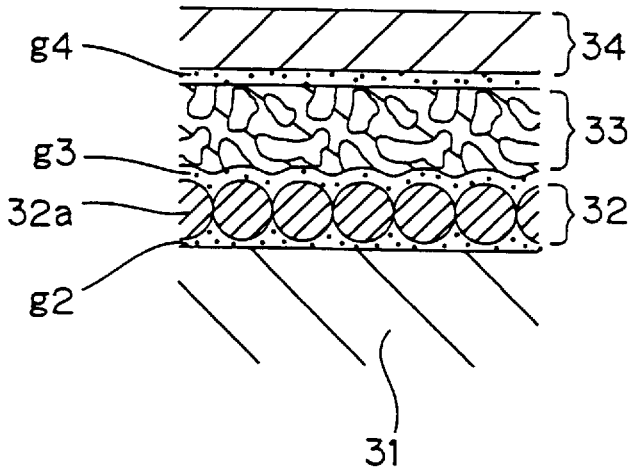

Referring now to the drawings, the present embodiment will be described.

Figure 2:
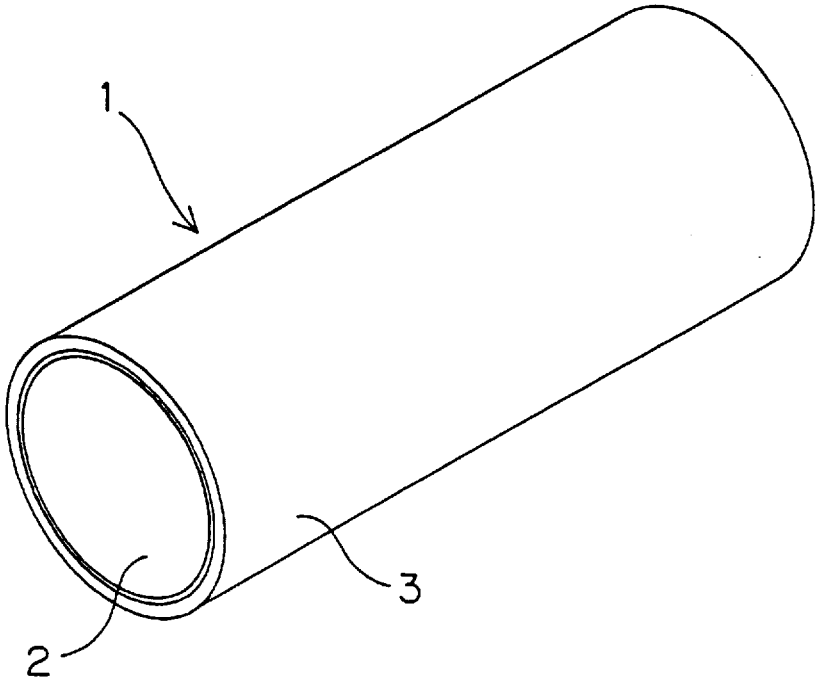
FIG. 2 is a perspective view showing the appearance of the printing blanket according to the above-mentioned embodiment.

A printing blanket 1 according to an embodiment comprises a blanket layer 3 in a seamless cylindrical shape which is formed on the outer periphery of a cylindrical sleeve 2 mounted on a blanket cylinder, as shown in FIG. 2. In the blanket layer 3, (i) a base layer 31 which comprises an elastomer, is non-compressible and is formed in a seamless cylindrical shape, (ii) a non-stretchable layer 32 obtained by winding a thread 32*a* which is non-stretchable in the longitudinal direction and is easy to deform in a direction perpendicular to the longitudinal direction, in a helical fashion in the circumferential direction, (iii) a compressible layer 33 which comprises an elastomer and is formed in a porous and seamless cylindrical shape, and (iv) a surface printing layer 34 which comprises an elastomer and is formed in a seamless cylindrical shape, are laminated in this order with adhesive layers g1 to g4 respectively interposed therebetween, as shown in FIGS. 1(*a*) and 1(*b*).

As the above-mentioned sleeve 2, it is possible to use all of a variety of conventionally known sleeves such as one made of a very thin metallic material and one formed of fiberglass reinforced plastic or the like. Particularly, sleeves made of nickel having a thickness of approximately 0.1 to 0.2 mm are suitably used in consideration of the rigidity, the strength and the elasticity.

The base layer 31 is formed by applying an unvulcanized rubber cement to be the adhesive layer g1 to an outer peripheral surface of the sleeve 2, and applying thereto an unvulcanized rubber cement to be the base layer 31 or winding a sheet composed of an unvulcanized rubber compound, followed by vulcanization. In the case of the above-mentioned vulcanization, the sheet is formed in a seamless cylindrical shape upon melting and integrating its seams.

As the elastomer composing the base layer 31, preferred is a synthetic rubber which is superior in vibration absorbability and impact load absorbability and has high damping properties with respect to vibration. It is preferable that the synthetic rubber has excellent oil resistance in consideration of the resistance to printing ink or the like. Specific examples of the synthetic rubber include acrylonitrile-butadiene copolymer rubber (NBR), chloroprene rubber (CR), and urethane rubber (U) which are not limitations. The base layer 31 is not essentially porous.

Although the thickness of the base layer 31 is not particularly limited, it is preferably 0.2 to 10.0 mm.

When the thickness of the base layer 31 is less than the above-mentioned range, the base layer 31 cannot satisfactorily absorb vibration and impact load. On the contrary, when the thickness exceeds the above-mentioned range, the surface printing layer greatly expands in the circumferential direction when a bulge occurs, so that the above-mentioned deformation of dots, for example, might occur.

The thickness of the base layer 31 is preferably 0.4 to 5.0 mm and more preferably 0.8 to 2.0 mm particularly even in the above-mentioned range.

The non-stretchable layer 32 is formed by applying a unvulcanized rubber cement to be the adhesive layer g2 to the base layer 31, winding thereon the thread 32*a* in helical fashion in the circumferential direction while applying a predetermined tensile force, and then vulcanizing the rubber cement.

Examples of the thread 32*a* include a variety of conventionally known strings for a non-stretchable layer such as a cotton string, a polyester string, a rayon string, a nylon string, and an aromatic polyamide string. The thread 32*a* could be a monofilament, or a yarn obtained by converging in parallel and integrating a plurality fibers or twisting the plurality of fibers. Particularly, the cotton string (twisted yarn) is suitably used in consideration of the degree to which the string does not easily stretch when it is pulled or the tensile strength in the longitudinal direction, the conformability with the rubber cement composing the adhesive layer g2, or the like.

Although the thickness of the non-stretchable layer 32 is not particularly limited, it is preferably 0.15 to 1.0 mm.

When the thickness of the non-stretchable layer 32 is less than the above-mentioned range, the non-stretchable layer 32 cannot sufficiently prevent the occurrence of the above-mentioned bulge and the resultant elongation in the circumferential direction of the surface printing layer, whereby the deformation of dots such as double or slurry might occur. Further, reaction force at the time of compression is reduced, so that dot or solid applicability might be reduced.

On the other hand, when the thickness of the non-stretchable layer 32 exceeds the above-mentioned range, the non-stretchable layer 32 itself is easily compressed along its thickness when it is pressed by the plate cylinder or the like. Therefore, the reaction force at the time of compression is reduced, so that the dot or solid applicability might be reduced.

The thickness of the non-stretchable layer 32 is preferably 0.2 to 0.8 mm and more preferably approximately 0.6 mm particularly even in the above-mentioned range in consideration of the improvement of the reaction force at the time of compression and the improvement of the resultant dot or solid applicability.

When the thread 32*a* is wound only once in helical fashion to form the non-stretchable layer 32 as shown, the diameter of the thread 32*a* corresponds to the thickness of the non-stretchable layer 32. In order to set the thickness of the non-stretchable layer 32 in the above-mentioned range, therefore, the diameter of the used thread 32*a* may be selected. Further, when the thread 32*a* is wound two or more times in helical fashion to form the non-stretchable layer 32, the number of windings, the manner of winding, and the diameter of the used thread 32*a* may be selected.

The compressible layer 33 is formed by applying an unvulcanized rubber cement to be the adhesive layer g3 to the non-stretchable layer 32, and then applying an unvulcanized rubber cement to be the compressible layer 33 or winding a sheet composed of a unvulcanized rubber compound, followed by vulcanization as in the case of the base layer 31. In the case of the above-mentioned vulcanization, the sheet is formed in a seamless cylindrical shape upon melting and integrating its seams as in the case of the base layer 31.

The compressible layer 33 must have a porous structure. Examples of the porous structure include a closed cell structure in which voids in matrix rubber are independent of each other, and an open cell structure in which voids connect with each other. In the present invention, either of the structures may be used.

As matrix rubber composing the compressible layer 33, synthetic rubber similar to that composing the base layer 31 is suitably used.

Although the porosity of the compressible layer 33 is not particularly limited, it is preferably 20 to 80% in the case of the closed cell structure, and is preferably 10 to 70% in the case of the open cell structure.

In a case where the porosity of the compressible layer 33 is less than the above-mentioned range, the compressible layer 33 cannot sufficiently prevent the occurrence of the bulge and the resultant elongation in the circumferential direction of the surface printing layer in either the closed cell structure or the open cell structure, whereby the deformation of dots such as double or slurry might occur. On the other hand, when the porosity exceeds the above-mentioned range, the reaction force at the time of compression is reduced, whereby the dot or solid applicability might be reduced.

The porosity of the compressible layer 33 having the closed cell structure is preferably 30 to 70% and more preferably 40 to 60% particularly even in the above-mentioned range.

The porosity of the compressible layer 33 having the open cell structure is preferably 20 to 60% and more preferably 30 to 50% particularly even in the above-mentioned range.

Although the thickness of the compressible layer 33 is not particularly limited, the thickness of the compressible layer in the closed cell structure or the open cell structure having the above-mentioned porosity is preferably 0.03 to 0.8 mm.

In either a case where the thickness of the compressible layer 33 is less than the above-mentioned range or a case where it exceeds the above-mentioned range, the compressible layer 33 cannot sufficiently prevent the occurrence of the above-mentioned bulge and the resultant elongation in the circumferential direction of the surface printing layer, whereby the deformation of dots such as double or slurry might occur. Further, if the thickness of the compressible layer 33 is less than the above-mentioned range, the reaction force at the time of compression is too high, whereby the dot or solid applicability is too high. Therefore, the printing quality might be rather decreased.

The thickness of the compressible layer 33 is preferably 0.03 to 0.5 mm and more preferably 0.05 to 0.3 mm particularly even in the above-mentioned range.

In order to form the compressible layer 33 having a closed cell structure, an expanding agent or a hollow microsphere which forms the basis of the closed cell structure may be contained in the unvulcanized rubber cement or compound. When the expanding agent is used, therefore, the expanding agent is decomposed by heat at the time of the vulcanization to emit gas, whereby the closed cell structure is formed in the matrix rubber. In the case of the hollow microsphere, it goes without saying that the closed cell structure is formed simultaneously with the blend thereof.

As the expanding agent for forming the closed cell structure in the compressible layer 33, all of a variety of conventionally known expanding agents can be used for rubber.

Specific examples of the expanding agent include azodicarbonamide, N,N'-dinitrosopentamethylenetetramine, and p,p'-oxybis(benzenesulfonylhydrazide), which are not limitations.

On the other hand, examples of the hollow microsphere include one obtained by sealing gas such as air into a closed shell formed of thermoplastic resin, thermosetting resin such as phenol resin, or inorganic matter such as glass. A shell formed of flexible thermoplastic resin is particularly preferable in maintaining the flexibility of the compressible layer 33.

Examples of the hollow microsphere comprising such a shell made of thermoplastic resin include EXPANCEL SERIES available from EXPANCEL Corporation in which a shell is formed of a copolymer of vinylidene chloride and acrylonitrile, which is not a limitation.

The amount of addition of the expanding agent, the particle diameter and the amount of addition of the hollow microsphere, or the like may be suitably set in conformity to the above-mentioned porosity of the compressible layer 33, for example.

In order to form the compressible layer 33 having an open cell structure, a so-called leaching method for containing particles, such as common salt particles, which can be extracted by a solvent which does not affect rubber (water in the case of the common salt particles) in an unvulcanized rubber cement or compound and vulcanizing the rubber cement or compound, and then extracting the particles may be utilized. According to such a leaching method, traces of the extracted particle form an open cell structure.

It is preferable in terms of safety and cost that water is used as a solvent for extraction as particles for forming an open cell structure by the leaching method, whereby particles which can be extracted by water are suitably used.

Examples of such particles which can be extracted by water include a variety of water-soluble organic matter and inorganic matter such as common salt (sodium chloride), starch, sugar, polyvinyl alcohol, gelatin, urea, cellulose, sodium sulfate, and potassium chloride.

The particle diameter, the amount of addition, and the like of the above-mentioned particles are also suitably set in conformity to the above-mentioned porosity of the compressible layer 33, for example.

The surface printing layer 34 is formed by applying an unvulcanized rubber cement to be the adhesive layer g4 to the compressible layer 33, and then applying thereto an unvulcanized rubber cement to be the surface printing layer or winding a sheet composed of an unvulcanized rubber compound, followed by vulcanization as in the cases of the base layer 31 and the compressible layer 33. In the case of the vulcanization, the sheet is formed in a seamless cylindrical shape upon melting and integrating its seams as in the cases of the base layer 31 and the compressible layer 33.

As the rubber composing the surface printing layer 34, polysulfide rubber (T), hydrogenated NBR and the like can be also used in addition to synthetic rubber similar to those composing the base layer 31 and the compressible layer 33. The surface printing layer 34 is not essentially porous.

Although the thickness of the surface printing layer 34 is not particularly limited, it is preferably 0.1 to 0.6 mm.

When the thickness of the surface printing layer 34 is less than the above-mentioned range, the reaction force at the time of compression is reduced, so that the dot or solid applicability might be reduced.

On the other hand, when the thickness of the surface printing layer 34 exceeds the above-mentioned range, the surface printing layer 34 cannot sufficiently prevent the occurrence of the above-mentioned bulge and the resultant elongation in the circumferential direction of the surface printing layer, so that the deformation of dots such as double or slurry might occur.

The thickness of the surface printing layer 34 is preferably 0.2 to 0.4 mm and more preferably 0.2 to 0.3 mm particularly even in the above-mentioned range.

Vulcanizable adhesives are respectively suitably used as the adhesive layers g1 to g4 formed among the layers. When the sleeve 2 is made of a metal, an adhesive layer superior in adhesive properties to both the metal and rubber composing the base layer 31 is suitably used as the adhesive layer g1.

It is preferable as such adhesives to simultaneously use an adhesive superior in adhesive properties to the metal and an adhesive superior in adhesive properties to the rubber composing the base layer 31. More specifically, preferable is an adhesive layer having a two-layer structure obtained by applying an adhesive superior in adhesive properties to the metal to the surface of the sleeve 2 using a doctor blade, a doctor roll or the like and drying the adhesive, and then similarly applying an adhesive superior in adhesive properties to the rubber composing the base layer 31 and drying the adhesive.

Examples of the former adhesive superior in the adhesive properties to the metal out of the two types of adhesives composing the adhesive layer having a two-layer structure include "CHEMLOCK 205", an adhesive available from Lord Chemical Corporation, which is not a limitation. When the base layer 31 is formed of NBR, for example, examples of the latter adhesive include "CHEMLOCK 252X" similarly available from Lord Chemical Corporation. The adhesives contain unvulcanized synthetic rubber. The adhesives are simultaneously vulcanized at the time of vulcanizing the base layer 31, to bond the sleeve 2 and the base layer 31.

As each of the other adhesive layers g2 to g4, an unvulcanized rubber cement mainly composed of rubber superior in compatibility with and adhesive properties to rubber composing its upper and lower layers, and particularly rubber similar to the rubber composing the upper and lower layers is suitably used.

The thickness of each of the adhesive layers g1 to g4 is preferably 0.1 to 1.0 mm, which is not a limitation. The thickness of the adhesive layer g1 is the total of the thicknesses of both the layers in the case of the above-mentioned two-layer structure.

When the thickness of each of the adhesive layers g1 to g4 is less than the above-mentioned range, the adhesive force might be insufficient. On the contrary, when the thickness exceeds the above-mentioned range, the above-mentioned synergistic action of the non-stretchable layer 32, the compressible layer 33, and the surface printing layer 34 might be interfered with.

The thickness of each of the adhesive layers g1 to g4 is preferably 0.2 to 0.8 mm and more preferably 0.25 to 0.5 mm particularly even in the above-mentioned range.

The above-mentioned layers composing the printing blanket 1 are successively laminated from the layer close to the sleeve 2 to the outer layer. Each of the layers may be vulcanized every time it is formed. Alternatively, a plurality of layers may be together vulcanized. For example, it is preferable that the compressible layer 33 having an open cell structure is vulcanized before the adhesive layer g4 and the surface printing layer 34 formed thereon are laminated in terms of extraction of particles for a leaching method as described above, to extract the particles.

In the cylindrical printing blanket 1 composed of the above-mentioned respective layers, reaction force produced when the printing blanket 1 is compressed and deformed in the radial direction such that the nip width in the circumferential direction is 5 mm is preferably 4.0 to 7.0 kgf/cm.

When the reaction force is less than the above-mentioned range, the dot or solid applicability might be reduced. On the contrary, when it exceeds the above-mentioned range, the dot or solid applicability is too high, so that the printing quality might be rather decreased.

In order to set the reaction force in the above-mentioned range, the hardness and the thickness of rubber composing each of the layers, the porosity of the compressible layer, and the like may be respectively adjusted in the above-mentioned ranges, or a tensile force applied to the thread may be adjusted in winding the thread to form the non-stretchable layer.

The reaction force is preferably 4.5 to 6.5 kgf/cm and more preferably 5.0 to 6.0 kgf/cm particularly even in the above-mentioned range.

The printing blanket 1 in a cylindrical shape is used upon being mounted on the blanket cylinder of the printing press.

Various types of additives can be blended with the rubber compound or the rubber cement for each of the layers constituting the printing blanket 1 described above, as in the conventional example.

Examples of such additives include an antioxidant, a reinforcer, a filler, a softener, and a plasticizer in addition to compounds for vulcanizing rubber such as a vulcanizing agent, a vulcanization accelerator, an activator, and a retarder. The amount of addition of the additive may be approximately the same as that in the conventional example.

Examples of the above-mentioned vulcanizing agent include sulfur, an organic sulfur compound, and an organic peroxide. Examples of the organic sulfur compound include N,N'-dithiobismorpholine. Examples of the organic peroxide include benzoyl peroxide and dicumyl peroxide.

Examples of the vulcanization accelerator include organic accelerators such as thiuram vulcanization accelerators such as tetramethylthiuramdisulfide and tetramethylthiurammonosulfide; dithiocarbamic acids such as zinc dibutyldithiocarbamate, zinc diethyldithiocarbamate, sodium dimethyldithiocarbamate, and tellurium diethyldithiocarbamate; thiazoles such as 2-mercaptobenzothiazole and N-cyclohexyl-2-benzothiazolylsulfenamide; and thioureas such as trimethylthiourea and N,N'-diethylthiourea, or inorganic accelerators such as calcium hydroxide, magnesium oxide, titanium oxide, and litharge (PbO).

Examples of the activator include metal oxides such as zinc oxide, or fatty acids such as stearic acid, oleic acid, and cottonseed fatty acid.

Examples of the retarder include aromatic organic acids such as salicylic acid, phthalic anhydride, and benzoic acid; and nitroso compounds such as N-nitrosodiphenylamine, N-nitroso-2,2,4-trimethyl-1,2-dihydroquinone, and N-nitorosophenyl-β-naphtylamine.

Examples of the antioxidant include imidazoles such as 2-mercaptobenzimidazole; amines such as phenyl-α-naphthylamine, N,N'-di-β-naphthyl-p-phenylenediamine, and N-phenyl-N'-isopropyl-p-phenylenediamine; and phenols such as di-t-butyl-p-cresol and styrenated phenol.

As the reinforcer, carbon black is mainly used. Further examples of the reinforcer include inorganic reinforcers such as silica or silicate white carbon, zinc oxide, surface treated precipitated calcium carbonate, magnesium carbonate, talc, and clay, or organic reinforcers such as coumarone-indene resin, phenol resin, and high styrene resin (a styrene-butadiene copolymer having a large styrene content).

Examples of the filler include inorganic fillers such as calcium carbonate, clay, barium sulfate, diatomaceous earth, mica, asbestos, and graphite, or organic fillers such as reclaimed rubber, rubber powder, asphalts, styrene resin, or glue.

Examples of the softener include various softeners of a vegetable oil, a mineral oil and a synthetic oil such as fatty acids (stearic acid, lauric acid, etc.), cottonseed oil, tall oil, asphalts, and paraffin wax.

Examples of the plasticizer include various vulcanizers such as dibutyl phthalate, dioctyl phthalate, and tricresyl phosphate.

In addition thereto, a tackifier, a dispersant, a solvent, or the like may be suitably blended with rubber.

The construction of the printing blanket according to the present invention is not limited to that in the above-mentioned embodiment. Various design changes can be made in the range in which the gist of the present invention is not changed.

For example, the base layer 31 may be omitted.

Furthermore, the thread 32*a* composing the non-stretchable layer 32 may be wound with its adjacent parts spaced apart from each other without being brought into contact with each other as shown.

An adhesive layer under a layer formed by applying a rubber cement out of the layers or an adhesive layer between two layers simultaneously vulcanized, for example, may be omitted.

The other layers can be suitably subjected to changes.

In short, if the non-stretchable layer 32 obtained by winding the thread 32*a* which is non-stretchable in the longitudinal direction and is easy to deform in a direction perpendicular to the direction and wound in helical fashion in the circumferential direction, the compressible layer 33 formed in a porous and seamless cylindrical shape, and the surface printing layer 34 formed in a seamless cylindrical shape are laminated in this order directly or with the adhesive layers interposed therebetween, the other construction is not particularly limited.

As described in detail in the foregoing, according to the present invention, high-quality prints can be obtained in a wide range from ordinary printing to high-speed printing, and the degree of degradation of printing properties due to the reduction in the reaction force with time is low. Therefore, the printing conditions need not be frequently adjusted. Moreover, it is possible to provide a printing blanket capable of maintaining good printing properties in the early stages of fabrication over a longer time period than that in the conventional example.

EXAMPLES

Examples 1 to 4

<Formation of Base Layer>

A sleeve 2 made of nickel having an inner diameter of 169.5 mm, having a length of 910 mm, and having a thickness of 0.125 mm (available from Taiyo Kogyo Co., Ltd.) was mounted on a mandrel for vulcanization having a similar mounting sleeve mechanism under pressure gas to that of a blanket cylinder. The outer peripheral surface of the sleeve 2 was coated with the above-mentioned "CHEMLOCK 205" and was dried, and was then coated with the above-mentioned "CHEMLOCK 252X" and was dried, to form an adhesive layer g1 having a two-layer structure (0.05 mm in total thickness).

An unvulcanized compound which comprises the following ingredients was kneaded using a kneader (available from Moriyama Seisakusho Co., Ltd.), and was then extruded using a 14×36-inch roll (available from KANSAI ROLL Co., Ltd.) to prepare a sheet having a thickness of 2.0 mm and having a width of 900 mm. The sheet was affixed to the adhesive layer g1.

{Compound for base layer}

| (ingredients) | (parts by weight) |
|---|---|
| Unvulcanized NBR | 100 |
| Furnace black (filler) | 60 |
| Silica filler | 40 |
| Stearic acid (plasticizer) | 1 |
| Aromatic oil (plasticizer) | 10 |
| Amine antioxidant | 1.5 |
| Powder sulfur (vulcanizing agent) | 2.5 |
| Guanidine accelerator | 1 |
| Sulfenic amide accelerator | 0.5 |
| Zinc oxide (activator) | 5 |
| Phtalic anhydride (retarder) | 0.5 |

The surface of the above-mentioned sheet was wrapped with a nylon band having a width of 30 mm using a wrapping machine (available from Sumitomo Rubber Industries, Ltd.), and the adhesive layer and the sheet were then vulcanized by using a vulcanizing furnace (1000×2000 mm; available form KANSAI ROLL Co., Ltd.) at 140° and 3 kg/cm$^2$ for 90 minutes.

The surface of the sheet after vulcanized was polished using a cylindrical grinding machine (available from Toyo Koki Co., Ltd.), to form a base layer 31 having a thickness as shown in Table 1 as described later (within ±0.01 mm in dimensional tolerance).

<Formation of non-stretchable layer>

On the surface of the above-mentioned base layer 31, an unvulcanized rubber cement for an adhesive layer which comprises the following ingredients was applied using a rotational spreading machine to which a doctor roll is applied (available from Sumitomo Rubber Industries, Ltd.), and was air-dried for 30 minutes, to form an adhesive layer g2 (0.05 mm in thickness).

{Rubber cement for adhesive layer}

| (ingredients) | (parts by weight) |
|---|---|
| Unvulcanized NBR | 90 |
| Unvulcanized CR | 10 |
| Clay filler | 70 |
| Stearic acid (plasticizer) | 1 |
| Phenol antioxidant | 1 |
| Powder sulfur (vulcanizing agent) | 1 |
| Guanidine accelerator | 1 |
| Sulfenic amide accelerator | 1 |
| Zinc oxide (activator) | 5 |
| Thermosetting resin (tackifire) | 5 |
| Magnesium oxide | 3 |
| Toluene (solvent) | 100 |

On the above-mentioned adhesive layer g2, a cotton string (0.4 mm in diameter) was wound in helical fashion while applying a tensile force of 400±50 gf such that the spacing between its adjacent parts is not more than 0.05 mm. A cylindrical shaping machine (available from Sumitomo Rubber Industries, Ltd.) was used for winding the cotton string.

The surface of the wound cotton string was wrapped by tightly winding a cotton-woven sheet (1000 mm in width) in the circumferential direction, and the adhesive layer was vulcanized by using the above-mentioned vulcanizing furnace at 140° C. and 3 kg/cm$^2$ for 90 minutes, to form a non-stretchable layer 32 having a thickness of 0.4 mm.

<Formation of compressible layer>

On the surface of the above-mentioned non-stretchable layer 32, the same unvulcanized rubber cement for an adhesive layer as used in the above-mentioned adhesive layer g2 was applied using the above-mentioned rotational spreading machine, and was air-dried for 30 minutes, to form an adhesive layer g3 (0.05 mm in thickness).

On the above-mentioned adhesive layer g3, an unvulcanized rubber cement for a compressible layer which comprises the following ingredients was then applied using the above-mentioned rotational spreading machine, and was air-dried for 12 hours, after which the surface of the compressible layer was wrapped by tightly winding a cotton-woven sheet (1000 mm in width) in the circumferential direction, and the adhesive layer and the compressible layer were vulcanized by using the above-mentioned vulcanizing furnace at 140° C. and 3 kg/cm$^2$ for 90 minutes.

{Rubber cement for compressible layer}

| (ingredients) | (parts by weight) |
|---|---|
| Unvulcanized NBR | 100 |
| Furnace black (filler) | 30 |
| Clay filler | 40 |
| Stearic acid (plasticizer) | 1 |
| Phenol antioxidant | 1 |
| Powder sulfur (vulcanizing agent) | 2.5 |
| Sulfenic amide accelerator | 1.5 |
| Thiuram accelerator | 1 |
| Zinc oxide (activator) | 5 |
| Hollow microsphere (*1) | 10 |
| Toluene (solvent) | 100 |

*1: A microsphere comprising a shell composed of a copolymer of vinylidene chloride and acrylonitrile.

The vulcanized surface was polished using the above-mentioned cylindrical grinding machine, to form a porous compressible layer 33 having a closed cell structure (0.2 mm in thickness, within ±0.01 in dimensional tolerance; and 40% in porosity).

<Formation of surface printing layer>

On the surface of the above-mentioned compressible layer 33, the same unvulcanized rubber cement for an adhesive layer as used in the above-mentioned adhesive layer g2 was applied using the above-mentioned rotational spreading machine, and was air-dried for 30 minutes, to form an adhesive layer g4 (0.05 mm in thickness).

On the adhesive layer g4, an unvulcanized rubber cement for a surface printing layer which comprises the following ingredients was then applied using the above-mentioned rotational spreading machine, and was air-dried for 12 hours, after which the surface of the surface printing layer was wrapped by tightly winding a cotton-woven sheet (1000 mm in width) in the circumferential direction, and the adhesive layer and the surface printing layer were vulcanized by using the above-mentioned vulcanizing furnace at 140° C. and 3 kg/cm$^2$ for 90 minutes.

{Rubber cement for surface printing layer}

| (ingredients) | (parts by weight) |
|---|---|
| Unvulcanized NBR | 100 |
| Clay filler | 40 |
| Stearic acid (plasticizer) | 1 |
| Processed oil (plasticizer) | 5 |
| Powder sulfur (vulcanizing agent) | 0.5 |
| Thiuram accelerator | 1 |
| Zinc oxide (activator) | 5 |
| Thermosetting resin (tackifire) | 3 |
| Quinoline compound | 1 |
| Toluene (solvent) | 100 |

The vulcanized surface was polished using the above-mentioned cylindrical grinding machine, to form a surface printing layer 34 having a thickness shown in Table 1 as described later (within ±0.01 in dimensional tolerance) and a surface roughness in ten points mean (Rz) of 3 to 5 $\mu$m, to fabricate a printing blanket having the layer structure shown in FIGS. 1(*a*) and 1(*b*).

Comparative Examples 1 to 3

<Formation of base layer>

An adhesive layer having a two-layer structure (0.05 mm in thickness), and a base layer (1.4 mm in thickness) were formed on an outer peripheral surface of the same sleeve as in the foregoing under the same conditions as in the foregoing using the same rubber cement and compound as used in the foregoing.

<Formation of compressible layer>

On the surface of the above-mentioned base layer, the same unvulcanized rubber cement for an adhesive layer as used in the foregoing was applied using the above-mentioned rotation spreading machine, and was air-dried for 30 minutes, to form an adhesive layer (0.05 mm in thickness), after which the surface of the compressible layer was wrapped by tightly winding a cotton-woven sheet (1000 mm in width) in the circumferential direction, and the adhesive layer and the compressible layer were vulcanized by using the above-mentioned vulcanizing furnace at 140° C. and 3 kg/cm$^2$ for 90 minutes.

{Rubber cement for compressible layer}

| (ingredients) | (parts by weight) |
|---|---|
| Unvulcanized NBR | 100 |
| Furnace black (filler) | 30 |
| Clay filler | 40 |
| Stearic acid (plasticizer) | 1 |
| Phenol antioxidant | 1 |
| Powder sulfur (vulcanizing agent) | 2.5 |
| Sulfenic amide accelerator | 1.5 |
| Thiuram accelerator | 1 |
| Zinc oxide (activator) | 5 |
| Common salt | 50 |
| Toluene (solvent) | 100 |

The compressible layer was immersed in warm water having a temperature of 70° C. for 12 hours to extract and remove common salt, and was then heated and dried at 100° C. for 60 minutes using an oven, after which the surface thereof was polished using the above-mentioned cylindrical grinding machine, to form a porous compressible layer having an open cell structure (0.3 mm in thickness, within ±0.01 mm in dimensional tolerance; and 40% in porosity).

<Formation of non-stretchable layer>

On the above-mentioned compressible layer, the same unvulcanized rubber cement for an adhesive layer as used in the foregoing was applied using the above-mentioned rotational spreading machine, and was air-dried for 30 minutes, to from an adhesive layer (0.05 mm in thickness).

On the above-mentioned adhesive layer, a cotton string (0.3 mm in diameter) was thus wound in helical fashion while applying the following tensile force using the above-mentioned cylindrical shaping machine (available from Sumitomo Rubber Industries, Ltd.) such that the spacing between its adjacent parts is not more than 0.05 mm.

{Tensile force of cotton string}

Comparative example 1: 0 gf

Comparative example 2: 380 gf

Comparative example 3: 1 kgf

The surface of the wound cotton string was wrapped by tightly winding a cotton-woven sheet (1000 mm in width) in the circumferential direction, and the adhesive layer was vulcanized using the above-mentioned vulcanizing furnace at 140° C. and 3 kg/cm for 90 minutes, to form a non-stretchable layer having a thickness of 0.3 mm.

<Formation of surface printing layer>

On the above-mentioned non-stretchable layer, the same unvulcanized rubber cement for an adhesive layer as used in the foregoing was applied using the above-mentioned rotational spreading machine, and was air-dried for 30 minutes, to form an adhesive layer (0.5 mm in thickness).

On the surface of the above-mentioned adhesive layer, the same unvulcanized rubber cement for a surface printing layer as used in the foregoing was then applied using the above-mentioned rotational spreading machine, and was air-dried for 12 hours, after which the surface of the surface printing layer was wrapped by tightly winding a cotton-woven sheet (1000 mm in width) in the circumferential direction, and the adhesive layer and the surface printing layer were vulcanized by using the above-mentioned vulcanizing furnace at 140° C. and 3 kg/cm$^2$ for 90 minutes.

The vulcanized surface was polished using the above-mentioned cylindrical grinding machine, to form a surface printing layer (0.2 mm in thickness, within ±0.01 mm in dimensional tolerance; and a surface roughness in ten points mean (Rz) of 3 to 5 $\mu$m, thereby fabricating a printing blanket having the conventional layer structure in which the non-stretchable layer was arranged on the compressible layer.

The following tests were conducted for each of the printing blankets in the examples and the comparative examples, to evaluate the characteristics thereof.

Measurement of difference in rolling length

Figure 3:
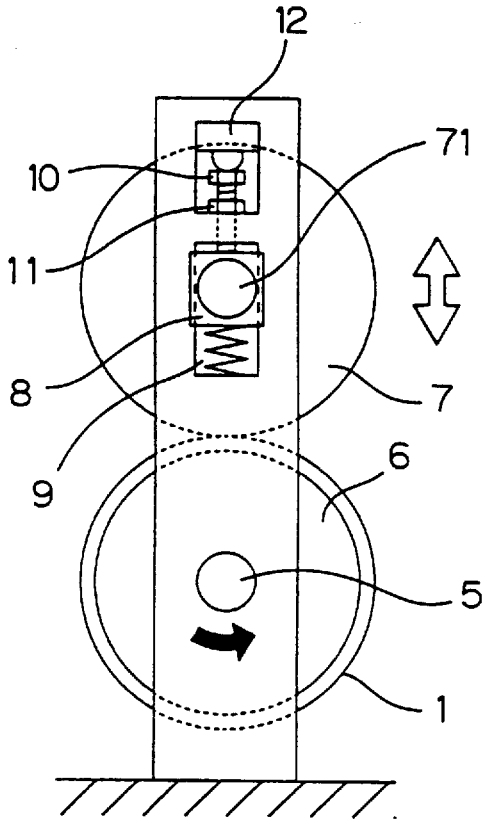
FIG. 3 is a front view showing an apparatus used for measuring the properties of printing blankets in examples and comparative examples.

The difference in rolling length (mm) of each of the printing blankets in the examples and the comparative examples was measured using an apparatus shown in FIG. 3.

The apparatus shown in FIG. 3 is for finding, in a state where a printing blanket 1 of a sample was mounted on a drum 6 fixed to a drive shaft 5 rotated in a direction indicated by a black arrow in FIG. 3 and having a similar sleeve mounting mechanism under pressure gas to that in the blanket cylinder, and a drum 7 corresponding to a plate cylinder of an web offset printing press is pressed against the printing blanket 1 from above in a predetermined amount of depression, the difference in rolling length (mm) from the difference between the numbers of revolutions of both the drums 6 and 7 in a case where the drive shaft 5 is rotated a predetermined number of times.

In FIG. 3, reference numeral 8 denotes a bearing unit which supports a shaft 71 of the drum 7 and is linearly movable upward and downward as indicated by a white arrow, reference numeral 9 denotes a spring which supports the bearing unit 8 from below, reference numerals 10 and 11 denote a bolt and a nut for adjusting the amount of depression of the drum 7 into the printing blanket 1 by adjusting the height of the bearing unit 8 upon being tightened or loosened, and reference numeral 12 denotes a load cell for measuring a pressing force of the drum 7 against the printing blanket 1.

The amount of depression of the drum 7 into the printing blanket 1 is measured by a dial gauge connected to the bearing unit 8, which is not illustrated.

The measuring conditions of the difference in rolling length using the above-mentioned apparatus are as follows:

| | |
|---|---|
| Diameter of the drum 6 | 170.000 mm |
| Diameter of the drum 7 | 174.415 mm |
| Amount of depression of the drum 7 into the printing blanket 1 | 0.15 mm |
| Rotational speed of the drive shaft 5 | 1000 r.p.m. |
| Number of revolutions of the drive shaft 5 | 500 times |

The difference in rolling length measured by the above-mentioned apparatus is shown with "plus mark (+)" in a case where the difference in the number of revolutions between the drum 6 and the drum 7 is plus (the drum 7 is rotated a larger number of times than the drum 6), while being shown with, "minus mark (−)" in a case where the above-mentioned difference is minus (the drum 7 is rotated a smaller number of times than the drum 6).

If the difference in rolling length is large in the positive direction (+), a bulge is increased, resulting in deformation of dots. Therefore, it is preferred as results that the measured difference in rolling length is smaller.

Measurement of nip reaction force

Reaction produced in pressing the drum 7 in such a manner that the nip width in the circumferential direction of the printing blanket 1 would be 5 mm in a state where both the drums 6 and 7 were stopped was measured by the load cell 12, and was converted to a value per centimeter (kgf/cm).

The foregoing results were shown in Tables 1 and 2.

TABLE 1

| | Thickness (mm) | | | | Difference in | Nip |
|---|---|---|---|---|---|---|
| | Base layer | Non-stretchable layer | Compressive layer | Surface printing layer | rolling length (mm) | reaction force (kgf/cm) |
| Ex.1 | 1.5 | 0.4 | 0.2 | 0.1 | −2 | 3.5 |
| Ex.2 | 1.4 | 0.4 | 0.2 | 0.2 | −1 | 5.5 |
| Ex.3 | 1.2 | 0.4 | 0.2 | 0.4 | 0 | 6.0 |
| Ex.4 | 1.0 | 0.4 | 0.2 | 0.6 | +1 | 7.0 |

TABLE 2

| | Thickness (mm) | | | | Difference in | Nip |
|---|---|---|---|---|---|---|
| | Base layer | Compressive layer | Non-stretchable layer | Surface printing layer | rolling length (mm) | reaction force (kgf/cm) |
| Comp. Ex.1 | 1.4 | 0.3 | 0.3 | 0.2 | +1 | 1.5 |
| Comp. Ex.2 | 1.4 | 0.3 | 0.3 | 0.2 | −1 | 6.0 |
| Comp. Ex.3 | 1.4 | 0.3 | 0.3 | 0.2 | +2 | 8.0 |

The foregoing Tables showed that in the printing blankets in the examples 1 to 4, the difference in rolling length was smaller and the nip reaction force was larger, as compared with those in the printing blankets having the conventional layer structure in the comparative examples 1 and 3, whereby good results of printing were obtained.

Comparison of the respective examples showed that the thickness of the surface printing layer was preferably 0.2 to 0.6 mm.

Comparative Example 4

A printing blanket was fabricated in the same manner as described in the example 1 except that the compressible layer was omitted, and the thickness of the surface printing layer was set to 0.3 mm (within ±0.01 mm in dimensional tolerance).

The above-mentioned tests were conducted for the printing blanket in the comparative example 4, to evaluate the characteristics thereof. The results, together with the results in the example 1, were shown in Table 3.

TABLE 3

| | Thickness (mm) | | | | Difference in | Nip |
|---|---|---|---|---|---|---|
| | Base layer | Non-stretchable layer | Compressive layer | Surface printing layer | rolling length (mm) | reaction force (kgf/cm) |
| Ex.1 | 1.5 | 0.4 | 0.2 | 0.1 | −2 | 3.5 |
| Comp. Ex.3 | 1.5 | 0.4 | — | 0.3 | +2 | 8.0 |

The foregoing Table showed that if the compressible layer was omitted, the difference in rolling length was larger and the nip reaction force was smaller, so that good results of printing were not obtained.

Examples 5 to 10

A printing blanket having the layer structure shown in FIGS. 1(*a*) and 1(*b*) was fabricated in the same manner as described in the example 2 except that the thicknesses of the base layer and the compressible layer were set to values shown in the following Table 4 (within ±0.01 mm in dimensional tolerance).

The above-mentioned tests were conducted for each of the printing blankets in the above-mentioned examples, to evaluate the characteristics thereof. The results, together with the results in the example 2, were shown in Table 4.

TABLE 4

| | Thickness (mm) | | | | Difference in | Nip |
|---|---|---|---|---|---|---|
| | Base layer | Non-stretchable layer | Com-pressive layer | Surface printing layer | rolling length (mm) | reaction force (kgf/cm) |
| Ex.5 | 1.7 | 0.4 | 0.03 | 0.2 | +0.05 | 6.5 |
| Ex.2 | 1.4 | 0.4 | 0.2 | 0.2 | −1 | 5.5 |
| Ex.6 | 1.2 | 0.4 | 0.4 | 0.2 | −0.3 | 4.5 |
| Ex.7 | 1.0 | 0.4 | 0.6 | 0.2 | +0.3 | 4.4 |
| Ex.8 | 0.9 | 0.4 | 0.7 | 0.2 | +0.5 | 4.3 |
| Ex.9 | 0.8 | 0.4 | 0.8 | 0.2 | +1 | 4.1 |
| Ex.10 | 0.6 | 0.4 | 1.0 | 0.2 | +2 | 3.9 |

The foregoing Table showed that the thickness of the compressible layer was preferably 0.03 to 0.8 mm.

Examples 11 to 17

A printing blanket having the layer structure shown in FIG. 1(*a*) and 1(*b*) was fabricated in the same manner as described in the example 2 except that the thicknesses of the base layer and the non-stretchable layer were values shown in the following Table 5 (within ±0.01 mm in dimensional tolerance).

The thickness of the non-stretchable layer was adjusted by changing the diameter of the cotton string composing the non-stretchable layer.

The above-mentioned tests were conducted for each of the printing blankets in the above-mentioned examples, to evaluate the characteristics thereof. The results, together with the results in the example 2, were shown in Table 5.

TABLE 5

| | Thickness (mm) | | | | Difference in | Nip |
|---|---|---|---|---|---|---|
| | Base layer | Non-stretchable layer | Com-pressive layer | Surface printing layer | rolling length (mm) | reaction force (kgf/cm) |
| Ex.11 | 1.7 | 0.1 | 0.2 | 0.2 | +2 | 3.9 |
| Ex.12 | 1.65 | 0.15 | 0.2 | 0.2 | +1 | 4.1 |
| Ex.13 | 1.6 | 0.2 | 0.2 | 0.2 | 0 | 4.5 |
| Ex.2 | 1.4 | 0.4 | 0.2 | 0.2 | −1 | 5.5 |
| Ex.14 | 1.2 | 0.6 | 0.2 | 0.2 | −1.5 | 5.5 |
| Ex.15 | 1.0 | 0.8 | 0.2 | 0.2 | −2 | 5.0 |
| Ex.16 | 0.8 | 1.0 | 0.2 | 0.2 | −2.2 | 4.0 |
| Ex.17 | 0.6 | 1.2 | 0.2 | 0.2 | −2.5 | 3.8 |

The foregoing Table showed that the thickness of the non-stretchable layer was preferably 0.15 to 1.0 mm.

Examples 18 to 21

A printing blanket having the layer structure shown in FIG. 1(*a*) and 1(*b*) was fabricated in the same manner as described in the example 2 except that the porosity of the compressible layer was a value shown in the following Table 6.

The porosity of the compressible layer was adjusted by changing the amount of the hollow microsphere contained in the rubber cement composing the compressible layer.

Examples 22 to 26

A printing blanket having the layer structure shown in FIGS. 1(*a*) and 1(*b*) was fabricated in the same manner as described in the example 2 except that the same rubber cement for an open cell structure as used in the comparative examples 1 to 3 was used as a rubber cement for a compressible layer, to form a compressible layer having an open cell structure (0.2 mm in thickness) having porosity shown in the following Table 6 by performing similar treatment to the above-mentioned treatment after vulcanization.

The porosity of the compressible layer was adjusted by changing the amount of common salt contained in the rubber cement composing the compressible layer.

The above-mentioned tests were conducted for each of the printing blankets in the above-mentioned examples, to evaluate the characteristics thereof. The results, together with the results in the example 2, were shown in Table 6.

TABLE 6

| | Compressive layer | | Difference in rolling | Nip |
|---|---|---|---|---|
| | Cell structure | Porosity (%) | length (mm) | Reaction (kgf/cm) |
| Ex.18 | closed | 10 | +1.5 | 7.0 |
| Ex.19 | closed | 20 | +1 | 6.8 |
| Ex.2 | closed | 40 | −1 | 5.5 |
| Ex.20 | closed | 80 | −2.2 | 4.2 |
| Ex.21 | closed | 90 | −2.5 | 3.8 |
| Ex.22 | open | 5 | +1.5 | 6.8 |
| Ex.23 | open | 10 | +1 | 6.5 |
| Ex.24 | open | 40 | −1.5 | 5.0 |
| Ex.25 | open | 70 | −2.5 | 4.0 |
| Ex.26 | open | 80 | −2.7 | 3.8 |

The foregoing Table showed that the compressible layer may be either a closed cell structure or an open cell structure, and the porosity thereof was preferably 20 to 80% in the case of the closed cell structure, while being preferably 10 to 70% in the case of the open cell structure.

Test for durability

The drive shaft 5 was rotated 20,000,000 times under the same conditions as those at the time of measuring the difference in rolling length using the apparatus shown in FIG. 3 for the printing blankets in the examples 2 and 5 and the comparative example 2, after which the difference in rolling length and the nip reaction force were measured in the same manner as described above.

The results, together with the above-mentioned results in the early stages of use, were shown in Table 7.

TABLE 7

| | Difference in rolling length (mm) | | Nip reaction force (kgf/cm) | |
|---|---|---|---|---|
| | Early stages of use | After 20,000,000 times | Early stages of use | After 20,000,000 times |
| Ex.2 | −1 | 0 | 5.5 | 6.0 |
| Ex.5 | +0.05 | +1 | 6.5 | 7.0 |
| Comp.Ex.2 | −1 | +1 | 6.0 | 4.0 |

The foregoing Table showed that the printing blankets in the examples 2 and 5 can withstand long-term use because the increase in the difference in rolling length is slighter and the nip reaction force is not reduced (rather increased) after being rotated 20,000,000 times, as compared with the printing blanket in the comparative example 2.

Evaluation of solid applicability

Each of the printing blankets in the examples and the comparative examples shown in the following Table 8 was set in a high-speed web offset printing press, 3×3 mm solid printing was done on the surface of wood free paper using oil based ink of Japanese-ink color, and the standard deviation of luminance for solid parts of the above-mentioned printing was measured using an image processing device [LA555 available from Piasu Co., Ltd.], to evaluate the solid applicability.

Figure 4:
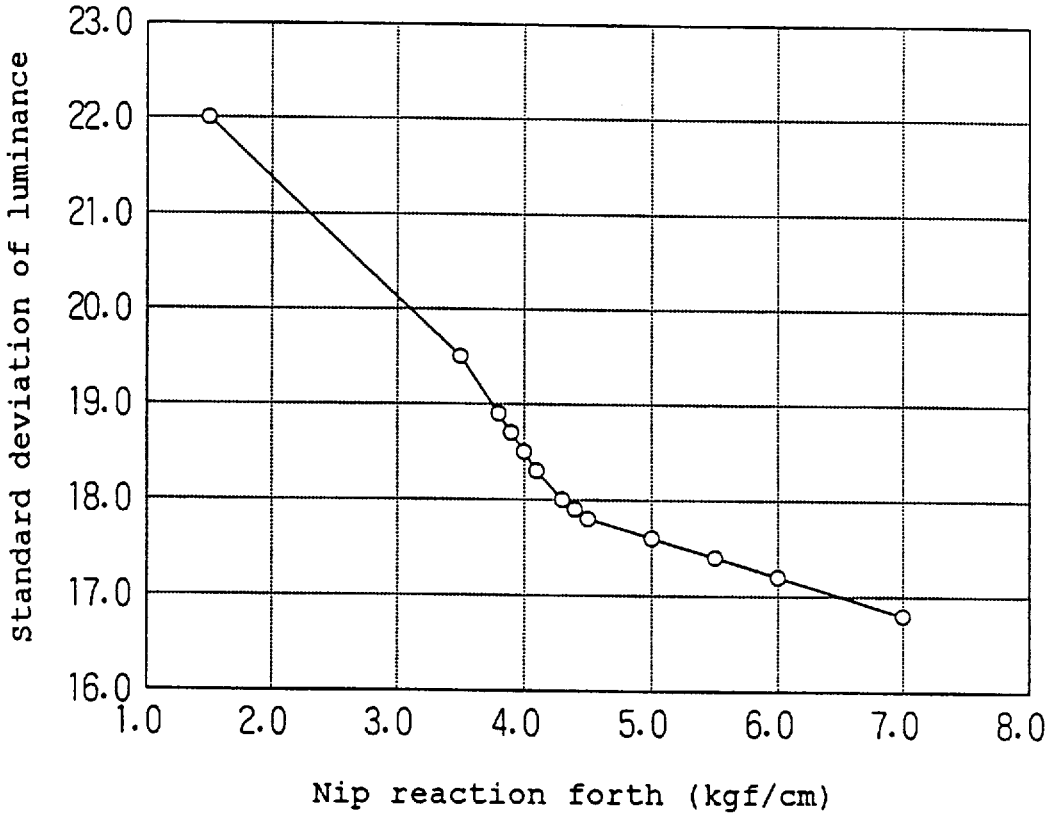
FIG. 4 is a graph showing the relationship between nip reaction force and standard deviation in luminance of a print in the printing blankets in the examples and the comparative examples.

The results, together with the above-mentioned results of the nip reaction force in each of the examples and the comparative examples, were shown in Table 8 and FIG. 4.

TABEL 8

| | Nip reaction force (kgf/cm) | Standard deviation of luminance |
|---|---|---|
| Comp.Ex.1 | 1.5 | 22.0 |
| Ex.1 | 3.5 | 19.5 |
| Ex.17 | 3.8 | 18.9 |
| Ex.10 | 3.9 | 18.7 |
| Ex.16 | 4.0 | 18.5 |
| Ex.9 | 4.1 | 18.3 |
| Ex.8 | 4.3 | 18.0 |
| Ex.7 | 4.4 | 17.9 |
| Ex.6 | 4.5 | 17.8 |
| Ex.15 | 5.0 | 17.6 |
| Ex.14 | 5.5 | 17.4 |
| Ex.3 | 6.0 | 17.2 |
| Ex.4 | 7.0 | 16.8 |

The foregoing Table and FIG. 4 showed that if the nip reaction force was not less than 3.5 kgf/cm, standard deviation in luminance of not more than 19.5 in a case where solid applicability was considered to be good could be achieved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing blanket having a seamless cylindrical configuration comprising:

(a) a non-stretchable layer obtained by winding a thread, which is non-stretchable in a longitudinal direction and is easy to deform in a direction perpendicular to the longitudinal direction, in a helical fashion in the circumferential direction of the cylindrical configuration;

(b) a compressible layer, which is laminated on the non-stretchable layer comprising an elastomer and formed in a porous and seamless cylindrical shape; and (c) a surface printing layer, which is laminated on the compressible layer comprising an elastomer and formed in a seamless cylindrical shape.

2. A printing blanket according to claim 1, wherein the compressible layer is directly formed on the non-stretchable layer.

3. A printing blanket according to claim 1, wherein the surface printing layer is directly formed on the compressible layer.

4. The printing blanket according to claim 1, wherein the non-stretchable layer is formed on a base layer, which, in turn, is laminated to the outer peripheral surface of a cylindrical sleeve to be directly mounted on a blanket cylinder comprising an elastomer, being non-compressible and formed in a seamless cylindrical shape.

5. The printing blanket according to claim 1, wherein the thickness of the non-stretchable layer is 0.15 to 1.0 mm, the thickness of the compressible layer is 0.03 to 0.8 mm, and the thickness of the surface printing layer is 0.2 to 0.6 mm.

6. The printing blanket according to claim 1, wherein the compressible layer has a closed cell structure, and the porosity thereof is 20 to 80%.

7. The printing blanket according to claim 1, wherein the compressible layer has an open cell structure, and the porosity thereof is 10 to 70%.

8. The printing blanket according to claim 1, wherein a reaction force of 4.0 to 7.0 kgf/cm is produced when the printing blanket is compressed and deformed in the radial direction such that the nip width in the circumferential direction is 5 mm.

9. The printing blanket of claim 1, wherein an adhesive layer is interposed between the non-stretchable layer and the compressive layer.

10. The printing blanket of claim 1, wherein an adhesive layer is interposed between the surface printing layer and the compressible layer.

11. The printing blanket of claim 4, wherein the cylindrical sleeve is mounted on the blanket cylinder with an adhesive layer interposed therebetween.

12. The printing blanket of claim 4, wherein the base layer has a thickness of 0.2 to 10.0 mm.

* * * * *